US008993204B2

(12) United States Patent
Nonaka et al.

(10) Patent No.: US 8,993,204 B2
(45) Date of Patent: Mar. 31, 2015

(54) ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

(75) Inventors: Masaki Nonaka, Suntou-gun (JP); Masato Tanaka, Tagata-gun (JP); Masataka Kawahara, Mishima (JP); Michiyo Sekiya, Mishima (JP); Akira Yoshida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 512 days.

(21) Appl. No.: 12/912,675

(22) Filed: Oct. 26, 2010

(65) Prior Publication Data

US 2011/0129768 A1 Jun. 2, 2011

(30) Foreign Application Priority Data

Nov. 27, 2009 (JP) ..... 2009-270098
Oct. 14, 2010 (JP) ..... 2010-231610

(51) Int. Cl.

*G03G 15/00* (2006.01)
*G03G 21/18* (2006.01)
*G03G 5/05* (2006.01)

(Continued)

(52) U.S. Cl.

CPC ..... *G03G 21/1814* (2013.01); *G03G 5/0542* (2013.01); *G03G 5/0546* (2013.01); *G03G 5/0592* (2013.01); *G03G 5/0614* (2013.01); *G03G 5/071* (2013.01); *G03G 5/1473* (2013.01);

(Continued)

(58) Field of Classification Search

CPC ..... G03G 5/00; G03G 8/00; G03G 5/147; G03G 5/14708
USPC ..... 430/56, 58.7, 124, 59.2, 33, 130, 133
See application file for complete search history.

(56) References Cited

U.S. PATENT DOCUMENTS 4,444,863 A * 4/1984 Sano et al. ..... 430/83
5,035,969 A * 7/1991 Kondo et al. ..... 430/83

(Continued)

FOREIGN PATENT DOCUMENTS

EP 964309 A1 12/1999
JP 58065438 A * 4/1983
JP 2007-272191 A 10/2007
JP 2007-272192 A 10/2007
JP 2007-279678 A 10/2007

OTHER PUBLICATIONS http://128.104.77.228/documnts/pdf1996/conne96a.pdf, Urea-Formaldehyde Adhesive Resins, Anthony H. Conner, Forest Products Laboratory USDA Forest Service, 1996, CRC Press, Inc.*

*Primary Examiner* — Peter Vajda
*Assistant Examiner* — Rashid Alam
(74) *Attorney, Agent, or Firm* — Canon U.S.A. Inc., IP Division

(57) ABSTRACT

According to aspects of the present invention, an electrophotographic photosensitive member includes a surface layer comprising a cured resin obtained by polymerizing a compound having at least one polymerizable functional group. Aspects of the present invention provide an electrophotographic photosensitive member whose surface layer comprises a compound (urea derivative) having a certain structure, a method for producing the electrophotographic photosensitive member, and a process cartridge and an electrophotographic apparatus including the electrophotographic photosensitive member.

12 Claims, 2 Drawing Sheets

(51) Int. Cl.

| | |
|---|---|
| ***G03G 5/06*** | (2006.01) |
| ***G03G 5/07*** | (2006.01) |
| ***G03G 5/147*** | (2006.01) |

(52) U.S. Cl.

CPC ..... *G03G 5/14734* (2013.01); *G03G 5/14791* (2013.01); *G03G 5/14795* (2013.01); *G03G 2215/00957* (2013.01)

USPC ..... 430/58.7; 430/56; 430/130; 430/133

(56) References Cited

U.S. PATENT DOCUMENTS

| | | | | |
|---|---|---|---|---|
| 2003/0190545 | A1* | 10/2003 | Daimon et al. | 430/124 |
| 2006/0257771 | A1* | 11/2006 | Wayman et al. | 430/59.4 |
| 2007/0003851 | A1* | 1/2007 | Kawahara et al. | 430/59.2 |
| 2007/0212626 | A1* | 9/2007 | Toshine et al. | 430/58.7 |
| 2009/0035672 | A1* | 2/2009 | Yanagawa et al. | 430/33 |

* cited by examiner

ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

BACKGROUND OF THE INVENTION

1. Field of the Invention

The present invention relates to an electrophotographic photosensitive member and a method for producing the same, and a process cartridge and an electrophotographic apparatus including the electrophotographic photosensitive member.

2. Description of the Related Art

Electrophotographic photosensitive members (organic electrophotographic photosensitive members) that use an organic photoconductive substance have advantages of high productivity and low production costs because they can be produced by coating and have ease of film formation. Therefore, such electrophotographic photosensitive members have been widely investigated. In particular, the mechanical durability of electrophotographic photosensitive members has been attempted to be improved in order to lengthen the life of electrophotographic photosensitive members and achieve high image quality. Among the electrophotographic photosensitive members, an electrophotographic photosensitive member having a surface layer composed of a cured resin is put to practical use, for example, as a high-speed copying machine that requires high durability, because of its high wear resistance.

To improve the mechanical durability such as scratch resistance or wear resistance of electrophotographic photosensitive members, a technology is also known in which an additive is added to the surface layer of electrophotographic photosensitive members.

Japanese Patent Laid-Open Nos. 2007-272191, 2007-272192, and 2007-279678 each disclose a technology in which a certain amine compound is further added to the surface layer of electrophotographic photosensitive members, the surface layer containing a cured resin obtained by polymerizing a radical-polymerizable monomer mixture. The purpose of the technology is to improve blurred images by adding a certain amine compound to the surface layer, without decreasing the hardness (mechanical durability) due to polymerization inhibition.

However, as a result of the investigation conducted by the inventors of the present invention, it was found that the amine compounds disclosed in Japanese Patent Laid-Open Nos. 2007-272191, 2007-272192, and 2007-279678 degraded the electrical characteristics of electrophotographic photosensitive members. The mechanical durability such as scratch resistance was also not sufficient. Herein, the term "scratch" means an externally obvious scratch formed on the surface of an electrophotographic photosensitive member, the scratch being caused when the surface of the electrophotographic photosensitive member is subjected to local mechanical stress. Such a scratch can also be recognized on an output image as a damaged image (a scratch-shaped white patch or black line).

SUMMARY OF THE INVENTION

Aspects of the present invention provide an electrophotographic photosensitive member that includes a surface layer comprising a cured resin obtained by polymerizing a compound having at least one polymerizable functional group and that has high wear resistance, good electrical characteristics, and high scratch resistance, and a method for producing the electrophotographic photosensitive member.

Aspects of the present invention also provide a process cartridge and an electrophotographic apparatus including the above-described electrophotographic photosensitive member.

According to aspects of the present invention, an electrophotographic photosensitive member includes a surface layer comprising a cured resin obtained by polymerizing a compound having at least one polymerizable functional group, wherein the surface layer comprises a compound represented by general formula (1) below.

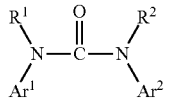

(1)

In general formula (1), $R^1$ and $R^2$ are each independently an alkyl group having 1 to 3 carbon atoms and $Ar^1$ and $Ar^2$ are each independently a substituted or unsubstituted aryl group. Herein, a substituent that may be included in the aryl group is a carboxyl group, a cyano group, a substituted or unsubstituted amino group, a hydroxyl group, a substituted or unsubstituted alkoxy group, a substituted or unsubstituted alkyl group, a nitro group, or a halogen atom.

According to aspects of the present invention, a method for producing an electrophotographic photosensitive member includes the steps of forming a coated film using a surface layer-forming coating solution that contains a compound having at least one polymerizable functional group and a compound represented by general formula (1) above; and polymerizing the compound having at least one polymerizable functional group, the compound being contained in the coated film, to form a surface layer.

According to aspects of the present invention, a process cartridge detachably installed in a main body of an electrophotographic apparatus includes the above-described electrophotographic photosensitive member, and at least one unit selected from a charging unit, a developing unit, a transferring unit, and a cleaning unit, wherein the process cartridge integrally supports the electrophotographic photosensitive member and the at least one unit.

According to aspects of the present invention, an electrophotographic apparatus includes the above-described electrophotographic photosensitive member, a charging unit, an exposure unit, a developing unit, and a transferring unit.

Japanese Patent Laid-Open No. 58-065438 discloses a single-layer electrophotographic photosensitive member formed of a photoconductive composition that contains a urea compound. However, the improvement in scratch resistance is not mentioned at all.

It is described in Japanese Patent Laid-Open No. 63-097959 that scratch resistance is improved by adding a urea compound to an electrophotographic photosensitive member. However, a specific investigation is not conducted. According to the experiment conducted by the inventors of the present invention, when the urea compound disclosed in Japanese Patent Laid-Open No. 63-097959 was added to a surface layer that contains a cured resin, the scratch resistance and wear resistance of the electrophotographic photosensitive member were decreased and the electrical characteristics were also significantly degraded.

Aspects of the present invention can provide an electrophotographic photosensitive member that includes a surface layer containing a cured resin obtained by polymerizing a compound having at least one polymerizable functional group and that has high wear resistance, good electrical characteristics, and high scratch resistance, and a method for producing the electrophotographic photosensitive member.

Aspects of the present invention can also provide a process cartridge and an electrophotographic apparatus including the above-described electrophotographic photosensitive member.

Further features of the present invention will become apparent from the following description of exemplary embodiments with reference to the attached drawings.

DESCRIPTION OF THE EMBODIMENTS

The detailed mechanism with which the effects according to aspects of the present invention are produced is unknown, but the inventors of the present invention believe the mechanism to be as follows.

The compound represented by general formula (1) has a chemical structure in which aryl groups ($Ar^1$ and $Ar^2$) in the molecule easily face each other. It is believed that the distance between the aryl groups facing each other is decreased (the aryl groups overlap with each other) due to the external pressure that would cause scratches on an electrophotographic photosensitive member, whereby the aryl groups function as a kind of spring at a molecular level and thus the external pressure can be immediately converted into thermal energy that is generated through a change in chemical structure. It is also believed that the aryl groups facing each other function as a conductive path having anisotropy, and thus the degradation of electrical characteristics can be prevented.

Urea compounds having an aryl group among those disclosed in Japanese Patent Laid-Open Nos. 58-065438 and 63-097959 do not have a structure in which short-chain alkyl groups ($R^1$ and $R^2$: alkyl groups having 1 to 3 carbon atoms) are directly bonded to a nitrogen atom. Therefore, aryl groups do not overlap with each other. Thus, it is believed that the effect as a spring obtained from the overlap of aryl groups is not produced.

An electrophotographic photosensitive member generally includes a support and a photosensitive layer formed on the support.

Figure 1A:
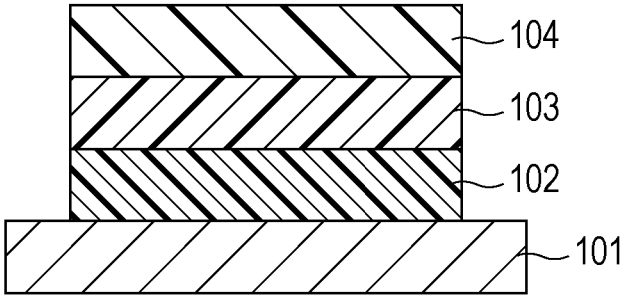
FIGS. 1A and 1B show examples of layer structures of electrophotographic photosensitive members.
Figure 1B:
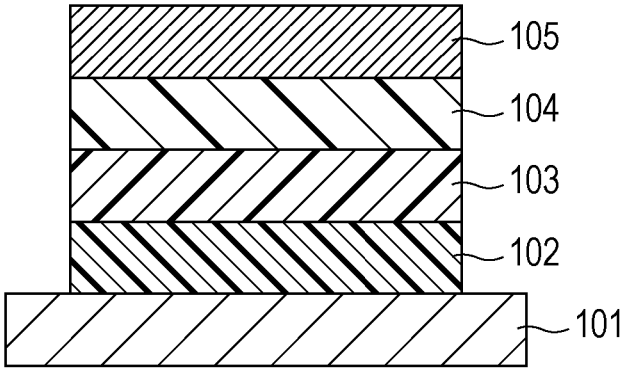

According to aspects of the present invention, the photosensitive layer of the electrophotographic photosensitive member may be a single-layer photosensitive layer (FIG. 1A) that includes a charge transporting layer and a charge generating layer in the same layer or may be a stacked photosensitive layer (FIG. 1B) that separately includes a charge generating layer containing a charge generating substance and a charge transporting layer containing a charge transporting substance. In terms of electrophotographic characteristics, a stacked photosensitive layer is favorably used. In FIGS. 1A and 1B, 101 denotes a support, 102 denotes an intermediate layer, 103 denotes a charge generating layer, 104 denotes a charge transporting layer, and 105 denotes a protective layer.

According to aspects of the present invention, a surface layer of the electrophotographic photosensitive member means a layer located at an outermost surface. For example, in the case of the electrophotographic photosensitive member having the layer structure shown in FIG. 1A, the surface layer of the electrophotographic photosensitive member is a charge transporting layer 104. In the case of the electrophotographic photosensitive member having the layer structure shown in FIG. 1B, the surface layer of the electrophotographic photosensitive member is a protective layer 105.

As described above, the surface layer of the electrophotographic photosensitive member according to aspects of the present invention comprises a cured resin obtained by polymerizing a compound having at least one polymerizable functional group. When the compound having at least one polymerizable functional group is polymerized, a polymerization initiator may be optionally used. The compound having at least one polymerizable functional group can be polymerized by using heat, light (e.g., ultraviolet light), or radiation (e.g., electron beam). Among them, the polymerization may be performed using radiation and even an electron beam because a polymerization initiator is not necessarily used if radiation is adopted. In the case where the compound having at least one polymerizable functional group is polymerized by using an electron beam, an electron beam may be applied in an inert gas atmosphere and heat treatment is then performed in an inert gas atmosphere to prevent the polymerization inhibition caused by oxygen. Examples of the inert gas include nitrogen and argon.

According to aspects of the present invention, the surface layer of the electrophotographic photosensitive member further comprises a compound (urea derivative, urea compound) represented by general formula (1) below.

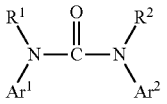

(1)

In general formula (1), $R^1$ and $R^2$ are each independently an alkyl group having 1 to 3 carbon atoms. Examples of the alkyl group include a methyl group, an ethyl group, and a propyl group (n-propyl group or isopropyl group). If $R^1$ and $R^2$ are hydrogen atoms, advantages according to aspects of the present invention are not achieved. In the case where $R^1$ and $R^2$ are each an alkyl group having 4 or more carbon atoms, $R^1$ and $R^2$ function as a factor that inhibits the formation of high-density structure (three-dimensional network structure) of a cured resin that constitutes the surface layer. Consequently, a surface layer having sufficient film strength is not obtained. If the film strength of the surface layer is insufficient, satisfactory wear resistance and scratch resistance are not achieved.

In general formula (1), $R^1$ and $R^2$ are each independently a substituted or unsubstituted aryl group. Examples of the substituted or unsubstituted aryl group include a substituted or unsubstituted phenyl group and a substituted or unsubstituted polycyclic aromatic group. Examples of the polycyclic aromatic group include a naphthyl group, a fluorene group, and a dimethylfluorene group. A substituent that may be included in the substituted or unsubstituted aryl group is limited to a carboxyl group, a cyano group, a substituted or unsubstituted amino group, a hydroxyl group, a substituted or unsubstituted alkoxy group, a substituted or unsubstituted alkyl group, a nitro group, and a halogen atom. Examples of the substituted amino group (an amino group having a substituent) include a dimethylamino group and a diethylamino group. Examples of the substituted or unsubstituted alkoxy group include a methoxy group and an ethoxy group. Examples of the substituted or unsubstituted alkyl group include a methyl group, an ethyl group, a propyl group (n-propyl group or isopropyl group), and trifluoromethyl group. Examples of the halogen atom include a fluorine atom, a chlorine atom, and a bromine atom.

To achieve a structure in which aryl groups in the molecule easily face each other, the compound represented by general formula (1) can have a symmetrical structure in which $R^1$ and $R^2$ are the same group and $Ar^1$ and $Ar^2$ are the same group in general formula (1).

According to aspects of the present invention, the surface layer of the electrophotographic photosensitive member can contain the compound represented by general formula (1) in an amount of 1 to 20% by mass relative to the total mass of the surface layer. If the amount is excessively small, advantages according to aspects of the present invention may be degraded. If the amount is excessively large, a high-density structure (three-dimensional network structure) of a cured resin that constitutes the surface layer is not achieved and thus the film strength of the surface layer may be decreased, and the compound represented by general formula (1) may be precipitated from the surface layer.

One or more of the compounds represented by general formula (1) may be contained in the surface layer of the electrophotographic photosensitive member.

The compound represented by general formula (1) can be synthesized, for example, by the method described in the documents below.

Photochem. Photobiol. Sci., 2002, 1, 30-37

Transactions of the Faraday Society, 34, 1938, 783-786

Tetrahedron Letters 39 (1998), 6267-6270

Bulletin of the chemical society of Japan, vol. 47 (4), 1974, 935-937

The compound represented by general formula (1) is exemplified below (example compound), but the present invention is not limited thereto.

(U-1)

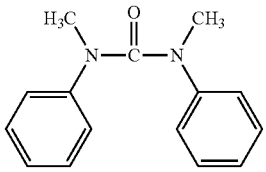

(U-2)

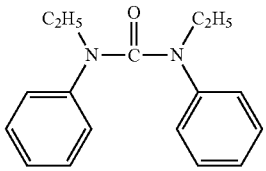

(U-3)

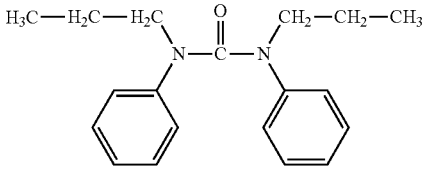

-continued (U-4)

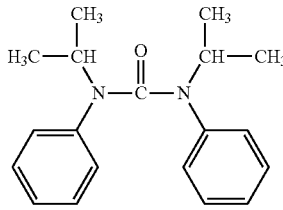

(U-5)

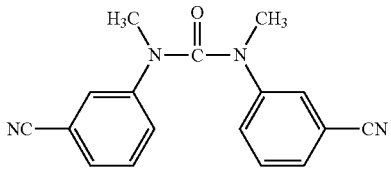

(U-6)

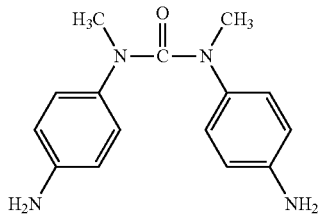

(U-7)

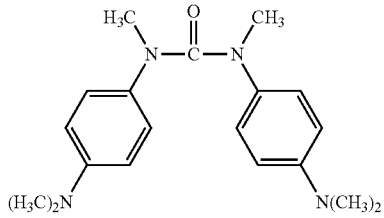

(U-8)

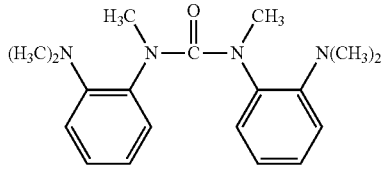

(U-9)

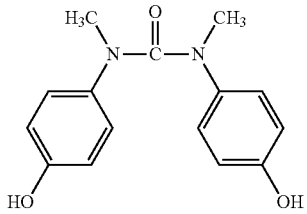

(U-10)

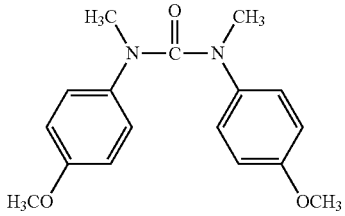

-continued (U-11)

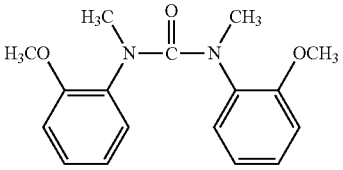

(U-12)

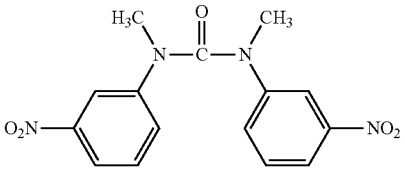

(U-13)

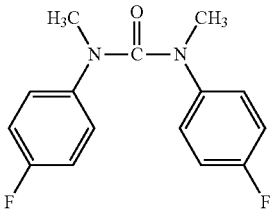

(U-14)

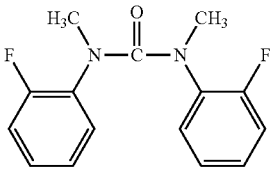

(U-15)

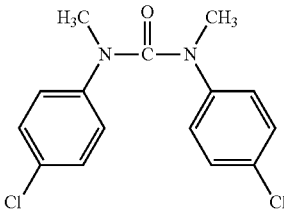

(U-16)

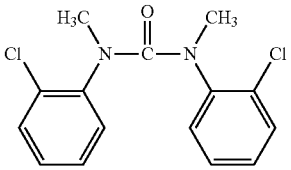

(U-17)

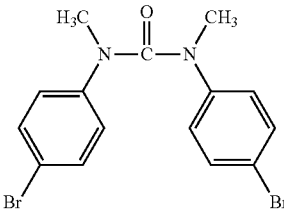

(U18)

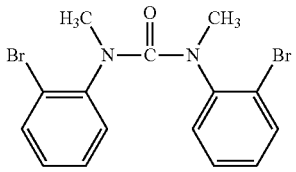

-continued (U-19)

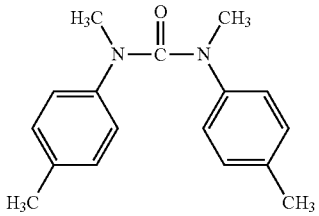

(U-20)

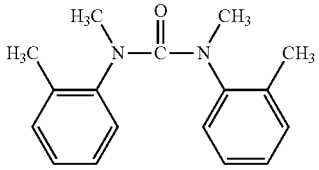

(U-21)

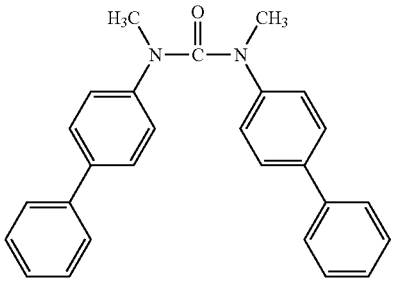

(U-22)

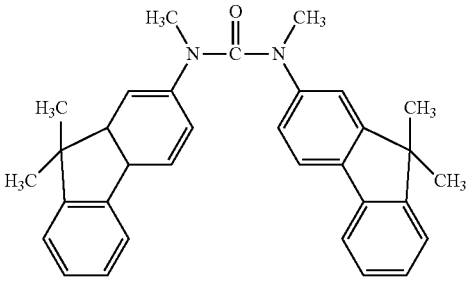

(U-23)

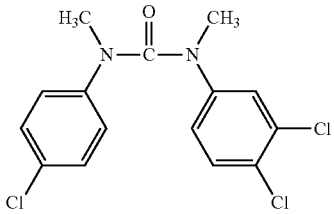

(U-24)

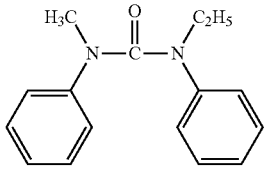

Among the compounds described above, the compound represented by structural formula (U-1), the compound represented by structural formula (U-2), and the compound represented by structural formula (U-10) can be favorably used. The compounds represented by structural formulas (U-1) to (U-24) are also referred to as example compounds (U-1) to (U-24).

The compound having at least one polymerizable functional group and used for the surface layer of the electrophotographic photosensitive member according to aspects of the present invention is a compound that can form a cured resin through polymerization. Examples of the compound include olefin compounds (compounds having only one double bond C═C), halogenated olefin compounds (compounds having only one double bond C═C and a halogen X (X is F, Cl, Br, or I)), diene compounds (compounds having two or more double bonds C═C), acetylene compounds (compounds having one or more triple bond C≡C), styrene compounds (compounds having a structure of C═C—Ar (Ar is an aromatic ring or heteroaromatic ring)), vinyl compounds (compounds having a vinyl group C═C—), acrylic acid compounds (compounds having a structure of C═C—CO—Z (Z is O, S, or N) or C═C—CN), cyclic ether compounds (cyclic compounds having an —O— bond in the ring), lactone compounds (cyclic compounds having a —CO—O— bond in the ring), lactam compounds (cyclic compounds having an —NH—CO— bond in the ring), cyclic amine compounds (cyclic compounds having an —NH— bond in the ring), cyclic sulfide compounds (cyclic compounds having a S atom in the ring), cyclic carbonate compounds (cyclic compounds having an —O—CO—O— bond in the ring), cyclic acid anhydrides (cyclic compounds having a —CO—O—CO— bond in the ring), cyclic imino ether compounds (cyclic compounds having an —N═C—O— bond in the ring), amino acid-N-carboxylic acid anhydride (cyclic compounds having an —O—CO—N═C—CO— bond in the ring), cyclic imide compounds (cyclic compounds having a —CO—NH—CO— bond, an —NH—CO—O— bond, or an —NH—CO—NH— bond in the ring), cyclic phosphorus-containing compounds (cyclic compounds having a P atom in the ring), cyclic silicon-containing compounds (cyclic compounds having a Si atom in the ring), cyclic olefin compounds (cyclic compounds whose ring is composed of carbon atoms or carbon multiple bonds), phenol compounds (compounds having an aromatic structure having a hydroxyl group), melamine/urea compounds (melamines or urea derivatives), diamine compounds (diamine derivatives including polyamine), dicarboxylic acid compounds (dicarboxylic acid (ester) derivatives), oxycarboxylic acid compounds (oxycarboxylic acid (ester) derivatives), amino carboxylic acid compounds (amino carboxylic acid (ester) derivatives), diol compounds (polyol having two or more free OH groups), diisocyanate compounds (iso(thio)cyanate derivatives), sulfur-containing compounds (sulfur (S)-containing monomers), phosphorus-containing compounds (phosphorus (P)-containing monomers), aromatic ether compounds (compounds in which aromatic hydrocarbon groups are bonded to each other with oxygen therebetween), dihalogen compounds (compounds having a plurality of carbon-halogen bonds other than acid halide), aldehyde compounds (compounds having an aldehyde group), diketone compounds, carbonic acid derivatives, aniline derivatives, and silicon compounds.

In terms of electrical characteristics, the compound having at least one polymerizable functional group may be a charge transporting compound having a charge transporting structure in a molecule. Examples of the charge transporting structure include structures of triarylamine, hydrazone, pyrazoline, and carbazole.

To increase polymerization efficiency, the polymerizable functional group may be an acrylic group (acryloyloxy group: $CH_2$═CHCOO—) or a methacrylic group (methacryloyloxy group: $CH_2$═C($CH_3$)COO—).

To form a satisfactory three-dimensional network structure in the surface layer of the electrophotographic photosensitive member, the compound having at least one polymerizable functional group may be a charge transporting compound having two or more polymerizable functional groups.

The compound having at least one polymerizable functional group may be a compound represented by general formula (4) below. The compound represented by general formula (4) below has a monoamine structure with high polymerization efficiency. In the structure, the number of polymerizable functional groups, which easily increase the internal stress of the surface layer and thus easily cause scratches if excessively present, is appropriately adjusted.

(4)

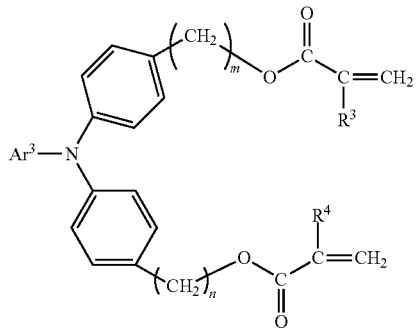

In general formula (4), $R^3$ and $R^4$ are each independently a hydrogen atom or a methyl group and $Ar^3$ is a substituted or unsubstituted aryl group. Herein, m and n are each independently an integer of 0 to 5. Examples of the substituted or unsubstituted aryl group include a phenyl group, a naphthyl group, a fluorenyl group, and a 9,9-dimethylfluorenyl group.

To increase the density of the three-dimensional network structure of the surface layer of the electrophotographic photosensitive member, $Ar^3$ in general formula (4) is a substituted or unsubstituted phenyl group.

Furthermore, to achieve both good electrical characteristics and high film strength (wear resistance and scratch resistance), the compound having at least one polymerizable functional group may be a compound represented by structural formula (5) below.

(5)

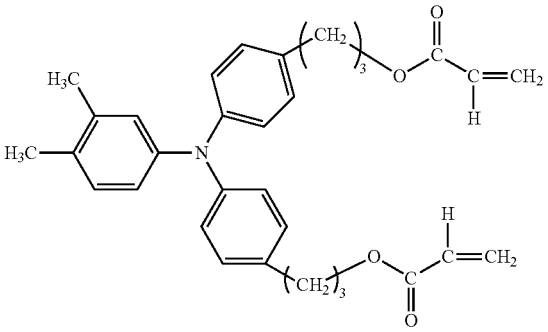

When the surface layer comprising a cured resin is formed, one or more of the compound having at least one polymerizable functional group may be used.

Any support having conductivity (conductive support) may be used for the support of the electrophotographic photosensitive member. For example, a support made of a metal such as aluminum, stainless steel, or nickel or a support made of a metal, plastic, or paper whose surface is coated with a conductive film can be used. The support can have a cylindrical or film-like shape or the like. Among these supports, a cylindrical support made of aluminum is suitable in terms of mechanical strength, electrophotographic characteristics, and cost. An open pipe may be used as a support without any treatment, but an open pipe whose surface is subjected to physical treatment such as cutting or honing, anodic oxidation treatment, or chemical treatment that uses an acid or the like may be used as a support. A support having a surface roughness Rz of 0.1 μm or more and 3.0 μm or less that is achieved by subjecting an open pipe to physical treatment such as cutting or honing has a satisfactory interference fringe-suppressing function.

A conductive layer (not shown in FIGS. 1A and 1B) can be optionally formed between the support and the photosensitive layer or an intermediate layer described below. The conductive layer is not necessarily formed when the support itself has an interference fringe-suppressing function. However, an open pipe is used as a support without any treatment and a conductive layer is formed thereon, whereby an interference fringe-suppressing function can be easily imparted. Therefore, the conductive layer is quite useful in terms of productivity and cost. The conductive layer can be formed by the method below. First, a conductive layer-forming coating solution is prepared by dispersing inorganic particles of tin oxide, indium oxide, titanium oxide, barium sulfate, or the like in an appropriate solvent together with a curable resin such as a phenol resin and optionally by adding roughening particles. The coating solution is applied on the support, and the resultant film is dried by heating to form a conductive layer. To impart an interference fringe-suppressing function and to coat defects formed on the support, the thickness of the conductive layer can be 10 μm or more and 30 μm or less.

An intermediate layer may be formed on the support or the conductive layer to ensure adhesion between the support and a photosensitive layer, to protect a photosensitive layer from electrical breakdown, and to improve the carrier injection into a photosensitive layer.

The intermediate layer can be formed by applying an intermediate layer-forming coating solution obtained by dissolving a resin in a solvent and then drying the coated film.

Examples of the resin used for the intermediate layer include acrylic resins, allyl resins, alkyd resins, ethyl cellulose resins, ethylene-acrylic acid copolymers, epoxy resins, casein resins, silicone resins, gelatin resins, phenol resins, butyral resins, polyacrylate, polyacetal, polyamide-imide, polyamide, poly(allyl ether), polyimide, polyurethane, polyester, polyethylene, polycarbonate, polystyrene, polysulfone, polyvinyl alcohol, polybutadiene, polypropylene, urea resins, agarose resins, and cellulose resins.

Examples of a solvent used for the intermediate layer-forming coating solution include benzene, toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide.

The thickness of the intermediate layer can be 0.1 μm or more and 5 μm or less.

A photosensitive layer may be formed on the support, the conductive layer, or the intermediate layer.

Examples of a charge generating substance include azo pigments such as monoazo, bisazo, trisazo, and tetrakisazo pigments; phthalocyanine pigments such as gallium phthalocyanine and oxytitanium phthalocyanine; and perylene pigments. Among these substances, gallium phthalocyanine is suitable in terms of characteristic stability in environmental variation. Furthermore, in terms of high sensitivity, a hydroxygallium phthalocyanine crystal having strong peaks at Bragg angles 2θ of 7.4°±0.3° and 28.2°±0.3° in the X-ray diffraction spectrum measured using a CuKα characteristic X-ray may be used.

When the photosensitive layer is a stacked photosensitive layer, examples of the binding resin used in the charge transporting layer include insulating resins such as polyvinyl butyral, polyarylate, polycarbonate, polyester, phenoxy resins, polyvinyl acetate, acrylic resins, polyacrylamide, polyvinylpyridine, cellulose resins, urethane resins, epoxy resins, agarose resins, casein, polyvinyl alcohol, and polyvinylpyrrolidone. In addition, organic photoconductive polymers such as poly-N-vinylcarbazole, polyvinyl anthracene, and polyvinyl pyrene can be used.

Examples of a solvent used for a charge generating layer-forming coating solution include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide.

The charge generating layer can be formed by applying a charge generating layer-forming coating solution containing the charge generating substance and optionally the binding resin, and then by drying the coated film. The charge generating layer-forming coating solution may be prepared by adding only the charge generating substance to a solvent and performing dispersion treatment and then by adding the binding resin, or may be prepared by adding the charge generating substance and the binding resin to a solvent at the same time and performing dispersion treatment.

The thickness of the charge generating layer can be 0.05 μm or more and 5 μm or less.

Examples of a charge transporting substance include triarylamine compounds, hydrazone compounds, stilbene compounds, pyrazoline compounds, oxazole compounds, thiazole compounds, and triarylmethane compounds.

When the photosensitive layer is a stacked photosensitive layer, examples of the binding resin used in the charge transporting layer include insulating resins such as polyvinyl butyral, polyarylate, polycarbonate, polyester, phenoxy resins, polyvinyl acetate, acrylic resins, polyacrylamide, polyamide, polyvinylpyridine, cellulose resins, urethane resins, epoxy resins, agarose resins, casein, polyvinyl alcohol, and polyvinylpyrrolidone. In addition, organic photoconductive polymers such as poly-N-vinylcarbazole, polyvinyl anthracene, and polyvinyl pyrene can be used.

Examples of a solvent used for a charge transporting layer-forming coating solution include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, methyl cellosolve, methoxypropanol, dimethylformamide, dimethylacetamide, and dimethyl sulfoxide.

The charge transporting layer can be formed by applying a charge transporting layer-forming coating solution obtained by dissolving the charge transporting substance and optionally the binding resin in a solvent, and then by drying the coated film.

The thickness of the charge transporting layer can be 5 μm or more and 40 μm or less.

The surface layer of the electrophotographic photosensitive member according to aspects of the present invention has the above-described structure. Conductive particles, an ultraviolet absorber, a wear resistance improver may be further added to the surface layer. An example of the conductive particles is a metal oxide such as tin oxide particles. Examples of the wear resistance improver include fluorine-containing resin particles, alumina particles, and silica particles.

The thickness of the surface layer can be 0.5 μm or more and 20 μm or less.

Examples of a solvent used for a surface layer-forming coating solution include toluene, xylene, tetralin, chlorobenzene, dichloromethane, chloroform, trichloroethylene, tetrachloroethylene, carbon tetrachloride, methyl acetate, ethyl acetate, propyl acetate, methyl formate, ethyl formate, acetone, methyl ethyl ketone, cyclohexanone, diethyl ether, dipropyl ether, propylene glycol monomethyl ether, dioxane, methylal, tetrahydrofuran, water, methanol, ethanol, n-propanol, isopropanol, butanol, 1,1,2,2,3,3,4-heptafluorocyclopentane, 4-methylmorpholine, N,N'-dimethylcyclohexylamine, methyl cellosolve, methoxypropanol, dimethylformamide, dimethylacetamide, and dimethyl sulfoxide.

In the case where the electrophotographic photosensitive member has the layer structure shown in FIG. 1A, a surface layer having charge transportability is formed on the charge generating layer. In the case where the electrophotographic photosensitive member has the layer structure shown in FIG. 1B, a surface layer is formed on the charge transporting layer.

Each of the above-described layers can be formed by a coating method such as dip coating (dipping), spray coating, spinner coating, bead coating, blade coating, or beam coating.

Figure 2:
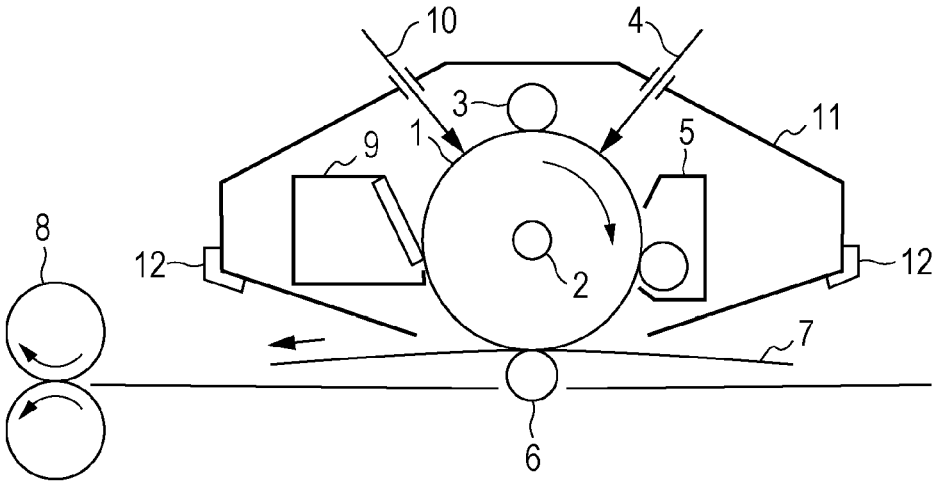
FIG. 2 shows an example of a schematic structure of an electrophotographic apparatus having a process cartridge including an electrophotographic photosensitive member according to aspects of the present invention.

FIG. 2 shows an example of a schematic structure of an electrophotographic apparatus having a process cartridge including the electrophotographic photosensitive member according to aspects of the present invention.

In FIG. 2, a drum-shaped electrophotographic photosensitive member 1 according to aspects of the present invention is rotated about a shaft 2 at a predetermined peripheral speed (processing speed) in a direction indicated by an arrow. In the rotation, the peripheral surface of the electrophotographic photosensitive member 1 is uniformly charged at a predetermined positive or negative potential by a charging unit (a first charging unit) 3. Next, the electrophotographic photosensitive member 1 is irradiated with exposure light 4 that is output from an exposure unit (not shown) providing slit exposure or laser beam scanning exposure and that is intensity-modulated in accordance with a time-series electrical digital pixel signal of intended image information. Thus, an electrostatic latent image corresponding to the intended image information is sequentially formed on the surface of the electrophotographic photosensitive member 1.

The formed electrostatic latent image is developed as a toner image with toner contained in a developing unit 5, by normal or reversal developing. The toner image formed and carried on the surface of the electrophotographic photosensitive member 1 is then sequentially transferred onto a transfer medium 7 by a transferring unit 6. In this process, the transfer medium 7 is fed from a feeding unit (not shown) into a portion between the electrophotographic photosensitive member 1 and the transferring unit 6 in synchronization with the rotation of the electrophotographic photosensitive member 1. In addition, a bias voltage having a polarity opposite to the charge polarity of the toner is applied to the transferring unit 6 from a bias power source (not shown). The transferring unit may adopt an intermediate transferring system, in which the transferring unit is constituted by a first transfer member, an intermediate transfer body, and a second transfer member.

The transfer medium 7 on which the toner image has been transferred is separated from the surface of the electrophotographic photosensitive member and conveyed to a fixing unit 8 where the toner image is subjected to a fixing process. After the fixing process, the transfer medium 7 is printed out as an image-formed matter (print or copy) to the outside of the electrophotographic apparatus.

A deposition, such as toner left on the surface of the electrophotographic photosensitive member 1 from which the toner image has been transferred to the transfer medium, is removed by a cleaning unit 9 and thus the surface is cleaned. The toner left without being transferred can be collected by a developing unit or the like. Furthermore, the electrophotographic photosensitive member 1 is de-charged by pre-exposure light 10 from a pre-exposure unit (not shown), and is then repeatedly used for image formation. In the case where the charging unit 3 is a contact charging unit that uses a charging roller or the like, pre-exposure is not necessarily required.

According to aspects of the present invention, two or more of the components, such as the electrophotographic photosensitive member 1, the charging unit 3, the developing unit 5, the transferring unit 6, the cleaning unit 9, and the like, may be accommodated in a container to constitute a process cartridge. The process cartridge may be detachably installed in the main body of an electrophotographic apparatus such as a copying machine or a laser beam printer. For example, at least one unit selected from the charging unit 3, the developing unit 5, the transferring unit 6, and the cleaning unit 9 can be integrally supported together with the electrophotographic photosensitive member 1 to constitute a process cartridge 11, which is detachably installed in the main body of the electrophotographic apparatus by using a guiding unit 12 such as a rail of the main body of the electrophotographic apparatus.

Aspects of the present invention will now be more specifically described based on Examples. However, the present invention is not limited thereto. In Examples, the term "part(s)" refers to "part(s) by mass".

EXAMPLES

Example 1

First, 50 parts of titanium oxide particles coated with tin oxide that contains 10% antimony oxide, 25 parts of resole phenolic resin, 20 parts of methyl cellosolve, 5 parts of methanol, and 0.002 parts of silicone oil (polydimethylsiloxane-polyoxyalkylene copolymer with an average molecular weight of 3000) were dispersed for 2 hours with a sand mill device that uses glass beads having a diameter of 0.8 mm to prepare a conductive layer-forming coating solution.

The conductive layer-forming coating solution was applied by dipping on an aluminum cylinder (drawn tube having an outer diameter of 30 mm) serving as the support, and the resultant film was dried at 140° C. for 30 minutes to form a conductive layer having a thickness of 15 μm.

Next, 2.5 parts of nylon 6-66-610-12 quaternary nylon copolymer resin (product name: CM8000 manufactured by Toray Industries, Inc.) and 7.5 parts of N-methoxymethylated 6-nylon resin (product name: Toresin EF-30T manufactured by Nagase ChemteX Corporation) were dissolved in a mixed solvent of 100 parts of methanol and 90 parts of butanol to prepare an intermediate layer-forming coating solution.

The intermediate layer-forming coating solution was applied on the conductive layer by dipping, and the resultant film was dried at 100° C. for 10 minutes to form an intermediate layer having a thickness of 0.55 μm.

Subsequently, 11 parts of hydroxygallium phthalocyanine crystals (charge generating substance) having strong peaks at Bragg angles of 7.4° and 28.2° in the X-ray diffraction spectrum measured using a CuKα characteristic X-ray were added to a solution obtained by dissolving 5 parts of polyvinyl butyral (product name: S-LEC BX-1 manufactured by Sekisui Chemical Co., Ltd.) in 130 parts of cyclohexanone. Five hundred parts of glass beads having a diameter of 1 mm were added thereto, and dispersion treatment was performed at 1800 rpm for 2 hours while the resultant solution was cooled with a 18° C. cooling water. The solution subjected to the dispersion treatment was diluted with 300 parts of ethyl acetate and 160 parts of cyclohexanone to prepare a charge generating layer-forming coating solution.

The average particle size (median) of the hydroxygallium phthalocyanine crystals contained in the charge generating layer-forming coating solution was measured with a centrifugal particle size analyzer (product name: CAPA700 manufactured by HORIBA, Ltd.) that uses liquid phase precipitation as a basic principle. The average particle size was 0.10 μm.

The charge generating layer-forming coating solution was applied on the intermediate layer by dipping, and the resultant film was dried at 110° C. for 10 minutes to form a charge generating layer having a thickness of 0.14 μm.

Next, 5 parts of a compound (charge transporting substance) represented by structural formula (6) below, 5 parts of a compound (charge transporting substance) represented by structural formula (7) below, and 10 parts of polycarbonate (product name: Iupilon 2400 manufactured by MITSUBISHI GAS CHEMICAL Company, Inc.) were dissolved in a mixed solvent of 70 parts of monochlorobenzene and 30 parts of dimethoxymethane to prepare a charge transporting layer-forming coating solution.

(6)

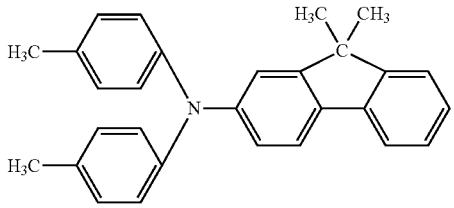

(7)

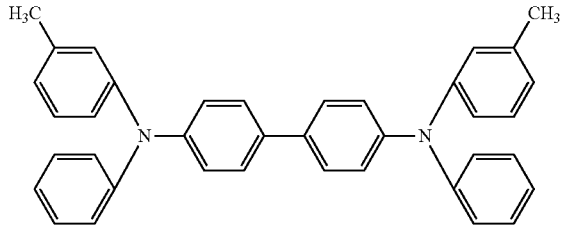

The charge transporting layer-forming coating solution was applied on the charge generating layer by dipping, and the resultant film was dried at 100° C. for 30 minutes to form a charge transporting layer having a thickness of 17 μm.

Subsequently, 49.75 parts of the compound represented by structural formula (5) above and 0.25 parts of an example compound (U-1) (manufactured by TOKYO CHEMICAL INDUSTRY Co., Ltd., GC purity: >97%) were dissolved in 25 parts of n-propanol. Furthermore, 25 parts of 1,1,2,2,3,3,4-heptafluorocyclopentane (product name: ZEORORA H manufactured by ZEON Corporation) was added thereto to prepare a protective layer-forming coating solution.

The protective layer-forming coating solution was applied on the charge transporting layer by dipping, and then heated at 50° C. for 5 minutes. The resultant film was irradiated with an electron beam for 1.5 seconds at an acceleration voltage of 80 kV at an absorbed dose of 19000 Gy in a nitrogen atmosphere. The film was then heated at 125° C. in a nitrogen atmosphere for 30 seconds. The oxygen concentration from the irradiation with an electron beam to the 30-second heat treatment was 19 ppm. Subsequently, heat treatment was performed at 100° C. in the air for 20 minutes to form a protective layer having a thickness of 4.8 μm.

Accordingly, an electrophotographic photosensitive member including the support, the conductive layer, the intermediate layer, the charge generating layer, the charge transporting layer, and the protective layer, which is the surface layer, was produced. This electrophotographic photosensitive member is referred to as an electrophotographic photosensitive member 1.

Example 2

An electrophotographic photosensitive member was produced in the same manner as in Example 1, except that, in Example 1, the protective layer-forming coating solution was prepared by changing the amount of the compound represented by structural formula (5) to 48.5 parts and the amount of the example compound (U-1) to 1.5 parts. This electrophotographic photosensitive member is referred to as an electrophotographic photosensitive member 2.

Example 3

An electrophotographic photosensitive member was produced in the same manner as in Example 1, except that, in Example 1, the protective layer-forming coating solution was prepared by changing the amount of the compound represented by structural formula (5) to 42.5 parts and the amount of the example compound (U-1) to 7.5 parts. This electrophotographic photosensitive member is referred to as an electrophotographic photosensitive member 3.

Example 4

An electrophotographic photosensitive member was produced in the same manner as in Example 1, except that, in Example 1, the protective layer-forming coating solution was prepared by changing the amount of the compound represented by structural formula (5) to 39 parts and the amount of the example compound (U-1) to 11 parts. This electrophotographic photosensitive member is referred to as an electrophotographic photosensitive member 4.

Example 5

An electrophotographic photosensitive member was produced in the same manner as in Example 2, except that, in Example 2, the protective layer-forming coating solution was changed to a protective layer-forming coating solution obtained by adding 48.5 parts of the compound represented by structural formula (5) above, 1.5 parts of the example compound (U-1), 13 parts of polytetrafluoroethylene particles (product name: Lubron L2 manufactured by Daikin Industries, Ltd.), and 1.5 parts of a resin (weight-average molecular weight: 130,000, copolymerization ratio (A1)/(A2)=1/1 (on a molar basis)) having a repeating structural unit represented by formula (A1) below and a repeating structural unit represented by formula (A2) below to a mixed solution of 25 parts of n-propanol and 25 parts of 1,1,2,2,3,3,4-heptafluorocyclopentane (product name: ZEORORA H manufactured by ZEON Corporation) and then by dispersing the mixture with an ultra-high pressure disperser. This is referred to as an electrophotographic photosensitive member 5.

(A1)

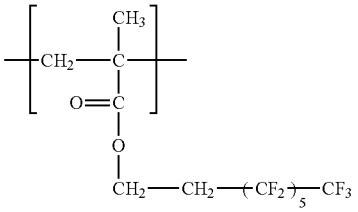

(A2)

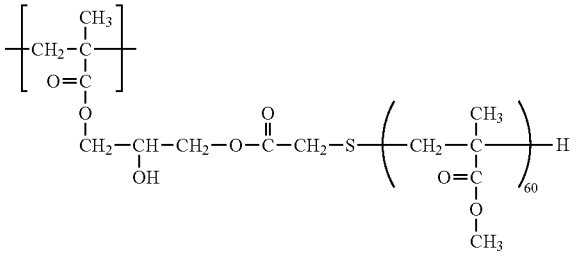

Example 6

An electrophotographic photosensitive member was produced in the same manner as in Example 1, except that, in Example 1, the example compound (U-1) was changed to the example compound (U-2) (manufactured by TOKYO CHEMICAL INDUSTRY Co., Ltd., GC purity: >98%). This is referred to as an electrophotographic photosensitive member 6.

Example 7

An electrophotographic photosensitive member was produced in the same manner as in Example 1, except that, in Example 2, the example compound (U-1) was changed to the example compound (U-2) (manufactured by TOKYO CHEMICAL INDUSTRY Co., Ltd., GC purity: >98%). This is referred to as an electrophotographic photosensitive member 7.

Example 8

An electrophotographic photosensitive member was produced in the same manner as in Example 1, except that, in Example 3, the example compound (U-1) was changed to the example compound (U-2) (manufactured by TOKYO CHEMICAL INDUSTRY Co., Ltd., GC purity: >98%). This is referred to as an electrophotographic photosensitive member 8.

Example 9

An electrophotographic photosensitive member was produced in the same manner as in Example 1, except that, in Example 4, the example compound (U-1) was changed to the example compound (U-2) (manufactured by TOKYO CHEMICAL INDUSTRY Co., Ltd., GC purity: >98%). This is referred to as an electrophotographic photosensitive member 9.

Example 10

An electrophotographic photosensitive member was produced in the same manner as in Example 1, except that, in Example 5, the example compound (U-1) was changed to the example compound (U-2) (manufactured by TOKYO CHEMICAL INDUSTRY Co., Ltd., GC purity: >98%). This is referred to as an electrophotographic photosensitive member 10.

Example 11

A protective layer-forming coating solution was prepared by further adding 2.5 parts of 1-hydroxycyclohexyl phenyl ketone (product name: Irgacure 184 manufactured by Ciba Specialty Chemicals, photopolymerization initiator) to the protective layer-forming coating solution prepared in Example 2 This protective layer-forming coating solution was applied on the charge transporting layer by dipping and then heated at 50° C. for 5 minutes. The resultant film was irradiated with light using a metal halide lamp at an irradiation intensity of 500 mW/cm$^2$ for 20 seconds and heated at 130° C. for 30 minutes to form a protective layer (surface layer) having a thickness of 4.8 μm. An electrophotographic photosensitive member was produced in the same manner as in Example 2, except for the above-described treatment. This is referred to as an electrophotographic photosensitive member 11.

Example 12

An electrophotographic photosensitive member was produced in the same manner as in Example 11, except that, in Example 11, the example compound (U-1) was changed to the example compound (U-2) (manufactured by TOKYO CHEMICAL INDUSTRY Co., Ltd., GC purity: >98%). This is referred to as an electrophotographic photosensitive member 12.

Example 13

An electrophotographic photosensitive member was produced in the same manner as in Example 2, except that, in Example 2, the compound represented by structural formula (5) above was changed to a compound represented by structural formula (8) below. This is referred to as an electrophotographic photosensitive member 13.

(8)

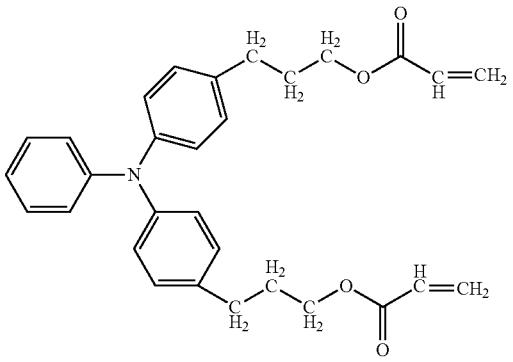

Example 14

An electrophotographic photosensitive member was produced in the same manner as in Example 13, except that, in Example 13, the example compound (U-1) was changed to the example compound (U-2) (manufactured by TOKYO CHEMICAL INDUSTRY Co., Ltd., GC purity: >98%). This is referred to as an electrophotographic photosensitive member 14.

Example 15

An electrophotographic photosensitive member was produced in the same manner as in Example 2, except that, in Example 2, the compound represented by structural formula (5) above was changed to a compound represented by structural formula (9) below. This is referred to as an electrophotographic photosensitive member 15.

(9)

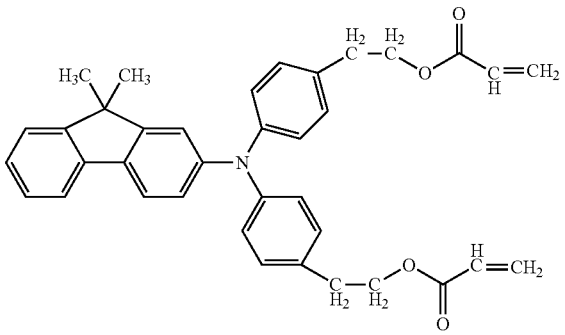

Example 16

An electrophotographic photosensitive member was produced in the same manner as in Example 15, except that, in Example 15, the example compound (U-1) was changed to the example compound (U-2) (manufactured by TOKYO CHEMICAL INDUSTRY Co., Ltd., GC purity: >98%). This is referred to as an electrophotographic photosensitive member 16.

Example 17

An electrophotographic photosensitive member was produced in the same manner as in Example 2, except that, in Example 2, the compound represented by structural formula (5) above was changed to a compound represented by structural formula (10) below. This is referred to as an electrophotographic photosensitive member 17.

Example 18

An electrophotographic photosensitive member was produced in the same manner as in Example 17, except that, in Example 17, the example compound (U-1) was changed to the example compound (U-2) (manufactured by TOKYO CHEMICAL INDUSTRY Co., Ltd., GC purity: >98%). This is referred to as an electrophotographic photosensitive member 18.

Example 19

The protective layer-forming coating solution of Example 2 was changed to a protective layer-forming coating solution obtained by dissolving 24.5 parts of dipentaerythritol hexaacrylate (product name: DPHA manufactured by DAICEL-CYTEC Company, Ltd.) (a compound having six acrylic groups, which are polymerizable functional groups, and having no charge transporting structure), 24 parts of a compound represented by structural formula (11), 2.5 parts of 1-hydroxycyclohexyl phenyl ketone (product name: Irgacure 184 manufactured by Ciba Specialty Chemicals, photopolymerization initiator), and 1.5 parts of the example compound (U-1) in 25 parts of n-propanol and then by further adding 25 parts of 1,1,2,2,3,3,4-heptafluorocyclopentane (product name: ZEORORA H manufactured by ZEON Corporation). This protective layer-forming coating solution was applied on the charge transporting layer by dipping and then heated at 50° C. for 5 minutes. The resultant film was irradiated with light using a metal halide lamp at an irradiation intensity of 500 mW/cm$^2$ for 20 seconds and heated at 130° C. for 30 minutes to form a protective layer (surface layer) having a thickness of 4.8 μm. An electrophotographic photosensitive member was produced in the same manner as in Example 2, except for the above-described treatment. This is referred to as an electrophotographic photosensitive member 19.

(11)

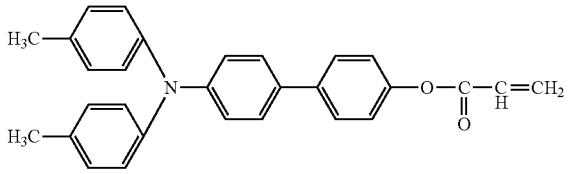

Example 20

An electrophotographic photosensitive member was produced in the same manner as in Example 19, except that, in (10)

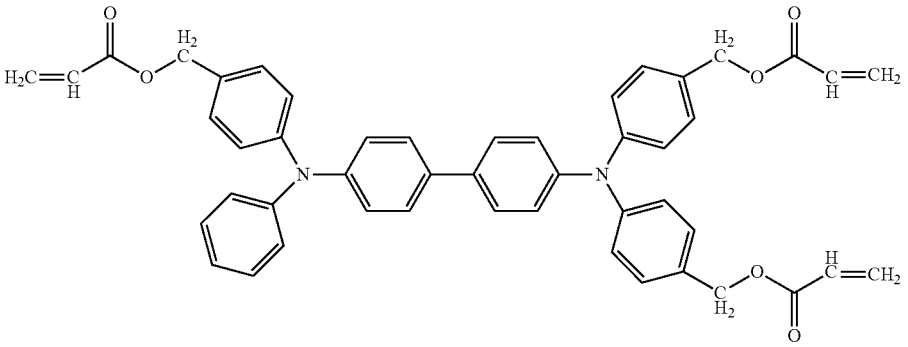

Example 19, the example compound (U-1) was changed to the example compound (U-2) (manufactured by TOKYO CHEMICAL INDUSTRY Co., Ltd., GC purity: >98%). This is referred to as an electrophotographic photosensitive member 20.

Example 21

The protective layer-forming coating solution of Example 2 was changed to a protective layer-forming coating solution obtained by dispersing 50 parts of tin oxide ultra-fine particles doped with antimony and surface-treated with a compound represented by structural formula (12) (the amount treated: 7%) and 150 parts of ethanol using a sand mill for 66 hours, further adding 20 parts of polytetrafluoroethylene particles (average particle size: 0.18 μm), dispersing the mixture for 2 hours, and dissolving 25 parts of resole phenolic resin (product name: PL-4804 manufactured by Gun Ei Chemical Industry Co., Ltd. and containing amine compounds other than ammonia) therein. This protective layer-forming coating solution was applied on the charge transporting layer by dipping, and the resultant film was heated at 150° C. for 60 minutes to form a protective layer (surface layer) having a thickness of 4.8 μm. An electrophotographic photosensitive member was produced in the same manner as in Example 2, except for the above-described treatment. This is referred to as an electrophotographic photosensitive member 21.

(12)

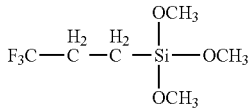

Example 22

An electrophotographic photosensitive member was produced in the same manner as in Example 21, except that, in Example 21, the example compound (U-1) was changed to the example compound (U-2) (manufactured by TOKYO CHEMICAL INDUSTRY Co., Ltd., GC purity: >98%). This is referred to as an electrophotographic photosensitive member 22.

Example 23

An electrophotographic photosensitive member was produced in the same manner as in Example 2, except that, in Example 2, the example compound (U-1) was changed to an example compound (U-3) synthesized in accordance with the method described in Photochem. Photobiol. Sci., 2002, 1, 30-37. This is referred to as an electrophotographic photosensitive member 23.

Example 24

An electrophotographic photosensitive member was produced in the same manner as in Example 2, except that, in Example 2, the example compound (U-1) was changed to an example compound (U-4) synthesized in accordance with the method described in Photochem. Photobiol. Sci., 2002, 1, 30-37. This is referred to as an electrophotographic photosensitive member 24.

Example 25

An electrophotographic photosensitive member was produced in the same manner as in Example 2, except that, in Example 2, the example compound (U-1) was changed to an example compound (U-6) synthesized in accordance with the method described in Photochem. Photobiol. Sci., 2002, 1, 30-37. This is referred to as an electrophotographic photosensitive member 25.

Example 26

An electrophotographic photosensitive member was produced in the same manner as in Example 2, except that, in Example 2, the example compound (U-1) was changed to an example compound (U-8) synthesized in accordance with the method described in Photochem. Photobiol. Sci., 2002, 1, 30-37. This is referred to as an electrophotographic photosensitive member 26.

Example 27

An electrophotographic photosensitive member was produced in the same manner as in Example 2, except that, in Example 2, the example compound (U-1) was changed to an example compound (U-9) synthesized in accordance with the method described in Photochem. Photobiol. Sci., 2002, 1, 30-37. This is referred to as an electrophotographic photosensitive member 27.

Example 28

An electrophotographic photosensitive member was produced in the same manner as in Example 2, except that, in Example 2, the example compound (U-1) was changed to an example compound (U-10) synthesized in accordance with the method described in Photochem. Photobiol. Sci., 2002, 1, 30-37. This is referred to as an electrophotographic photosensitive member 28.

Example 29

An electrophotographic photosensitive member was produced in the same manner as in Example 2, except that, in Example 2, the example compound (U-1) was changed to an example compound (U-12) synthesized in accordance with the method described in Photochem. Photobiol. Sci., 2002, 1, 30-37. This is referred to as an electrophotographic photosensitive member 29.

Example 30

An electrophotographic photosensitive member was produced in the same manner as in Example 2, except that, in Example 2, the example compound (U-1) was changed to an example compound (U-13) synthesized in accordance with the method described in Photochem. Photobiol. Sci., 2002, 1, 30-37. This is referred to as an electrophotographic photosensitive member 30.

Example 31

An electrophotographic photosensitive member was produced in the same manner as in Example 2, except that, in Example 2, the example compound (U-1) was changed to an example compound (U-15) synthesized in accordance with the method described in Photochem. Photobiol. Sci., 2002, 1, 30-37. This is referred to as an electrophotographic photosensitive member 31.

Example 32

An electrophotographic photosensitive member was produced in the same manner as in Example 2, except that, in Example 2, the example compound (U-1) was changed to an example compound (U-19) synthesized in accordance with the method described in Photochem. Photobiol. Sci., 2002, 1, 30-37. This is referred to as an electrophotographic photosensitive member 32.

Example 33

An electrophotographic photosensitive member was produced in the same manner as in Example 2, except that, in Example 2, the example compound (U-1) was changed to an example compound (U-20) synthesized in accordance with the method described in Photochem. Photobiol. Sci., 2002, 1, 30-37. This is referred to as an electrophotographic photosensitive member 33.

Example 34

An electrophotographic photosensitive member was produced in the same manner as in Example 2, except that, in Example 2, the example compound (U-1) was changed to an example compound (U-21) synthesized in accordance with the method described in Photochem. Photobiol. Sci., 2002, 1, 30-37. This is referred to as an electrophotographic photosensitive member 34.

Example 35

An electrophotographic photosensitive member was produced in the same manner as in Example 2, except that, in Example 2, the example compound (U-1) was changed to an example compound (U-22) synthesized in accordance with the method described in Photochem. Photobiol. Sci., 2002, 1, 30-37. This is referred to as an electrophotographic photosensitive member 35.

Example 36

An electrophotographic photosensitive member was produced in the same manner as in Example 2, except that, in Example 2, the example compound (U-1) was changed to an example compound (U-23) synthesized in accordance with the method described in Photochem. Photobiol. Sci., 2002, 1, 30-37. This is referred to as an electrophotographic photosensitive member 36.

Example 37

An electrophotographic photosensitive member was produced in the same manner as in Example 2, except that, in Example 2, the example compound (U-1) was changed to an example compound (U-24) synthesized in accordance with the method described in Photochem. Photobiol. Sci., 2002, 1, 30-37. This is referred to as an electrophotographic photosensitive member 37.

Comparative Example 1

An electrophotographic photosensitive member was produced in the same manner as in Example 2, except that, in Example 2, the example compound (U-1) was changed to a compound represented by structural formula (13) below. This is referred to as an electrophotographic photosensitive member C1.

(13)

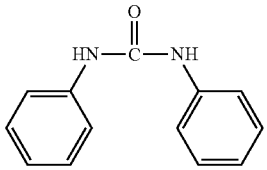

Comparative Example 2

An electrophotographic photosensitive member was produced in the same manner as in Example 2, except that, in Example 2, the example compound (U-1) was changed to a compound represented by structural formula (14) below. This is referred to as an electrophotographic photosensitive member C2.

(14)

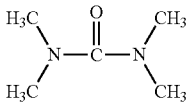

Comparative Example 3

An electrophotographic photosensitive member was produced in the same manner as in Example 2, except that, in Example 2, the example compound (U-1) was changed to a compound represented by structural formula (15) below. This is referred to as an electrophotographic photosensitive member C3.

(15)

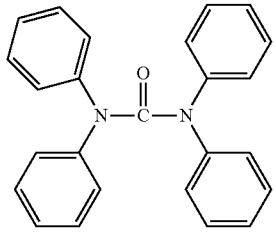

Comparative Example 4

An electrophotographic photosensitive member was produced in the same manner as in Example 2, except that, in Example 2, the example compound (U-1) was changed to a compound represented by structural formula (16) below. This is referred to as an electrophotographic photosensitive member C4.

(16)

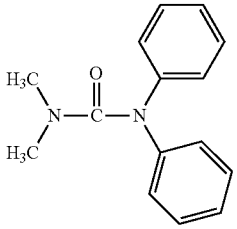

Comparative Example 5

An electrophotographic photosensitive member was produced in the same manner as in Example 2, except that, in Example 2, the example compound (U-1) was changed to a compound represented by structural formula (17) below. This is referred to as an electrophotographic photosensitive member C5.

(17)

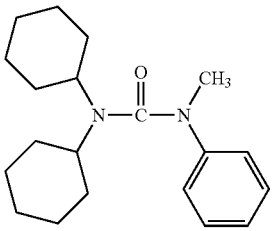

Comparative Example 6

An electrophotographic photosensitive member was produced in the same manner as in Example 2, except that, in Example 2, the example compound (U-1) was changed to a compound represented by structural formula (18) below. This is referred to as an electrophotographic photosensitive member C6.

(18)

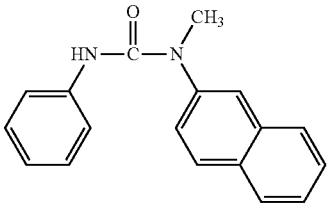

Comparative Example 7

An electrophotographic photosensitive member was produced in the same manner as in Example 2, except that, in Example 2, the example compound (U-1) was changed to a compound represented by structural formula (19) below. This is referred to as an electrophotographic photosensitive member C7.

(19)

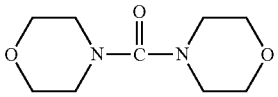

Comparative Example 8

An electrophotographic photosensitive member was produced in the same manner as in Example 2, except that, in Example 2, the example compound (U-1) was changed to a compound represented by structural formula (20) below. This is referred to as an electrophotographic photosensitive member C8.

(20)

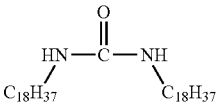

Comparative Example 9

An electrophotographic photosensitive member was produced in the same manner as in Example 2, except that, in Example 2, the example compound (U-1) was changed to diethyl phthalate (plasticizer). This is referred to as an electrophotographic photosensitive member C9.

Comparative Example 10

An electrophotographic photosensitive member was produced in the same manner as in Example 2, except that, in Example 2, the example compound (U-1) was changed to a compound represented by structural formula (21) below. This is referred to as an electrophotographic photosensitive member C10.

(21)

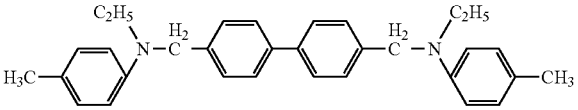

Comparative Example 11

An electrophotographic photosensitive member was produced in the same manner as in Example 11, except that, in Example 11, the example compound (U-1) was changed to the compound represented by structural formula (21) above. This is referred to as an electrophotographic photosensitive member C11.

Comparative Example 12

An electrophotographic photosensitive member was produced in the same manner as in Example 13, except that, in Example 13, the example compound (U-1) was changed to the compound represented by structural formula (21) above. This is referred to as an electrophotographic photosensitive member C12.

Comparative Example 13

An electrophotographic photosensitive member was produced in the same manner as in Example 15, except that, in Example 15, the example compound (U-1) was changed to the compound represented by structural formula (21) above. This is referred to as an electrophotographic photosensitive member C13.

Comparative Example 14

An electrophotographic photosensitive member was produced in the same manner as in Example 17, except that, in Example 17, the example compound (U-1) was changed to the compound represented by structural formula (21) above. This is referred to as an electrophotographic photosensitive member C14.

Comparative Example 15

An electrophotographic photosensitive member was produced in the same manner as in Example 19, except that, in Example 19, the example compound (U-1) was changed to the compound represented by structural formula (21) above. This is referred to as an electrophotographic photosensitive member C15.

Comparative Example 16

An electrophotographic photosensitive member was produced in the same manner as in Example 21, except that, in Example 21, the example compound (U-1) was changed to the compound represented by structural formula (21) above. This is referred to as an electrophotographic photosensitive member C16.

Comparative Example 17

An electrophotographic photosensitive member was produced in the same manner as in Example 2, except that, in Example 2, the example compound (U-1) was not used. This is referred to as an electrophotographic photosensitive member C17.

Comparative Example 18

An electrophotographic photosensitive member was produced in the same manner as in Example 11, except that, in Example 11, the example compound (U-1) was not used. This is referred to as an electrophotographic photosensitive member C18.

Comparative Example 19

An electrophotographic photosensitive member was produced in the same manner as in Example 13, except that, in Example 13, the example compound (U-1) was not used. This is referred to as an electrophotographic photosensitive member C19.

Comparative Example 20

An electrophotographic photosensitive member was produced in the same manner as in Example 15, except that, in Example 15, the example compound (U-1) was not used. This is referred to as an electrophotographic photosensitive member C20.

Comparative Example 21

An electrophotographic photosensitive member was produced in the same manner as in Example 17, except that, in Example 17, the example compound (U-1) was not used. This is referred to as an electrophotographic photosensitive member C21.

Comparative Example 22

An electrophotographic photosensitive member was produced in the same manner as in Example 19, except that, in Example 19, the example compound (U-1) was not used. This is referred to as an electrophotographic photosensitive member C22.

Comparative Example 23

An electrophotographic photosensitive member was produced in the same manner as in Example 21, except that, in Example 21, the example compound (U-1) was not used. This is referred to as an electrophotographic photosensitive member C23.

Comparative Example 24

An electrophotographic photosensitive member was produced in the same manner as in Example 1, except that, in Example 1, the protective layer was not formed. The electrophotographic photosensitive member whose charge transporting layer is a surface layer is referred to as an electrophotographic photosensitive member C24.

Comparative Example 25

An electrophotographic photosensitive member was produced in the same manner as in Comparative Example 24, except that a charge transporting layer-forming coating solution obtained by further adding 0.6 parts of the example compound (U-1) to the charge transporting layer-forming coating solution prepared in Comparative Example 24 was used. The electrophotographic photosensitive member whose charge transporting layer is a surface layer is referred to as an electrophotographic photosensitive member C25.

Evaluation of Characteristics of Surface Layer

The universal hardness and elastic deformation ratio of the surface layer of each of the electrophotographic photosensitive members 2, 7, C10, and C17 were measured with a hardness meter (product name: H100VP-HCU manufactured by Fischer Instrumentation Ltd. in Germany). A quadrangular pyramid diamond indenter (the angle between opposite faces was 136°) was pressed into a surface layer to be measured while a load was applied to the diamond indenter. The indentation depth while a load was applied to the diamond indenter was electrically detected. The measurement was performed in an environment of 23° C./50% RH.

As a universal hardness is increased, the mechanical strength becomes high. The universal hardness was determined by dividing the test load (final load: 2 mN) by the surface area of an indentation (calculated from the geometrical shape of the indenter) generated due to the test load.

As an elastic deformation ratio is increased, the elasticity becomes high. The elastic deformation ratio was determined by measuring the indentation depth and load until the load reached 0 by decreasing the test load (final load: 2 mN).

Durability Evaluation for Paper Feeding

Each of the electrophotographic photosensitive members 1 to 37 and C1 to C25 was installed in an electrophotographic copying machine (product name: iR4570 manufactured by CANON KABUSHIKI KAISHA). The dark potential was set to be −750 V, the light potential was set to be −160 V, and a durability test for 200000 sheets of paper feeding was performed in an environment of 27° C./75% RH. Herein, the presence or absence of image defects (damaged images) caused by the scratches formed on the surface of the electrophotographic photosensitive member was confirmed for every 10000 sheets through visual inspection (Examples 1 to 37 and Comparative Examples 1 to 25). Furthermore, regarding each of the electrophotographic photosensitive members 1 to 10, 23 to 37, and C1 to C10, C17, C24, and C25, the difference in light potential variation after 20000 sheets of paper feeding (=(light potential after 20000 sheets of paper feeding)−(initial light potential)) was confirmed (Examples 1 to 10 and 23 to 37 and Comparative Examples 1 to 10, 17, 24, and 25). In addition, regarding each of the electrophotographic photosensitive members 1 to 10, 23 to 37, and C1 to C10, and C17, the abrasion loss (μm) of the surface layer after 50000 sheets of paper feeding was confirmed (Examples 1 to 10 and 23 to 37 and Comparative Examples 1 to 10 and 17). Table shows the results.

TABLE

| | | Evaluation of characteristics of surface layer | | Durability evaluation for paper feeding | | |
|---|---|---|---|---|---|---|
| | Electrophotographic photosensitive member | Universal hardness ($N/mm^2$) | Elastic deformation ratio (%) | Formation of damaged image | Abrasion loss of surface layer after 50000 sheets of paper feeding (μm) | Difference in light potential variation after 20000 sheets of paper feeding (V) |
| Ex. 1 | 1 | — | — | Damaged image is not formed even after 200000 sheets | 0.10 | 30 |
| Ex. 2 | 2 | 200 | 57 | Damaged image is not formed even after 200000 sheets | 0.10 | 30 |
| Ex. 3 | 3 | — | — | Damaged image is not formed even after 200000 sheets | 0.10 | 30 |
| Ex. 4 | 4 | — | — | Damaged image is formed after 190000 sheets | 0.10 | 30 |
| Ex. 5 | 5 | — | — | Damaged image is not formed even after 200000 sheets | 0.10 | 35 |
| Ex. 6 | 6 | — | — | Damaged image is not formed even after 200000 sheets | 0.10 | 30 |
| Ex. 7 | 7 | 195 | 57 | Damaged image is not formed even after 200000 sheets | 0.10 | 30 |
| Ex. 8 | 8 | — | — | Damaged image is not formed even after 200000 sheets | 0.10 | 30 |
| Ex. 9 | 9 | — | — | Damaged image is formed after 190000 sheets | 0.10 | 30 |
| Ex. 10 | 10 | — | — | Damaged image is not formed even after 200000 sheets | 0.10 | 35 |
| Ex. 11 | 11 | — | — | Damaged image is formed after 160000 sheets | — | — |
| Ex. 12 | 12 | — | — | Damaged image is formed after 160000 sheets | — | — |
| Ex. 13 | 13 | — | — | Damaged image is formed after 190000 sheets | — | — |
| Ex. 14 | 14 | — | — | Damaged image is formed after 190000 sheets | — | — |
| Ex. 15 | 15 | — | — | Damaged image is formed after 180000 sheets | — | — |
| Ex. 16 | 16 | — | — | Damaged image is formed after 180000 sheets | — | — |
| Ex. 17 | 17 | — | — | Damaged image is formed after 160000 sheets | — | — |
| Ex. 18 | 18 | — | — | Damaged image is formed after 160000 sheets | — | — |
| Ex. 19 | 19 | — | — | Damaged image is formed after 120000 sheets | — | — |
| Ex. 20 | 20 | — | — | Damaged image is formed after 120000 sheets | — | — |
| Ex. 21 | 21 | — | — | Damaged image is formed after 120000 sheets | — | — |
| Ex. 22 | 22 | — | — | Damaged image is formed after 120000 sheets | — | — |
| Ex. 23 | 23 | — | — | Damaged image is formed after 180000 sheets | 0.10 | 30 |
| Ex. 24 | 24 | — | — | Damaged image is formed after 180000 sheets | 0.10 | 30 |
| Ex. 25 | 25 | — | — | Damaged image is formed after 180000 sheets | 0.10 | 35 |
| Ex. 26 | 26 | — | — | Damaged image is formed after 180000 sheets | 0.15 | 30 |
| Ex. 27 | 27 | — | — | Damaged image is formed after 180000 sheets | 0.10 | 35 |
| Ex. 28 | 28 | — | — | Damaged image is not formed even after 200000 sheets | 0.15 | 30 |
| Ex. 29 | 29 | — | — | Damaged image is formed after 180000 sheets | 0.15 | 35 |
| Ex. 30 | 30 | — | — | Damaged image is formed after 180000 sheets | 0.15 | 30 |
| Ex. 31 | 31 | — | — | Damaged image is formed after 180000 sheets | 0.15 | 30 |
| Ex. 32 | 32 | — | — | Damaged image is formed after 180000 sheets | 0.10 | 30 |
| Ex. 33 | 33 | — | — | Damaged image is formed after 180000 sheets | 0.10 | 30 |
| Ex. 34 | 34 | — | — | Damaged image is formed after 180000 sheets | 0.15 | 30 |
| Ex. 35 | 35 | — | — | Damaged image is formed after 180000 sheets | 0.15 | 30 |
| Ex. 36 | 36 | — | — | Damaged image is formed after 170000 sheets | 0.20 | 40 |
| Ex. 37 | 37 | — | — | Damaged image is formed after 170000 sheets | 0.20 | 40 |
| C. E. 1 | C1 | — | — | Damaged image is formed after 130000 sheets | 0.25 | 60 |
| C. E. 2 | C2 | — | — | Damaged image is formed after 130000 sheets | 0.25 | 65 |
| C. E. 3 | C3 | — | — | Damaged image is formed after 130000 sheets | 0.30 | 60 |
| C. E. 4 | C4 | — | — | Damaged image is formed after 130000 sheets | 0.25 | 60 |
| C. E. 5 | C5 | — | — | Damaged image is formed after 130000 sheets | 0.25 | 65 |
| C. E. 6 | C6 | — | — | Damaged image is formed after 120000 sheets | 0.30 | 60 |
| C. E. 7 | C7 | — | — | Damaged image is formed after 130000 sheets | 0.30 | 60 |
| C. E. 8 | C8 | — | — | Damaged image is formed after 140000 sheets | 0.40 | 60 |
| C. E. 9 | C9 | — | — | Damaged image is formed after 150000 sheets | 0.40 | 70 |
| C. E. 10 | C10 | 190 | 50 | Damaged image is formed after 120000 sheets | 0.30 | 60 |
| C. E. 11 | C11 | — | — | Damaged image is formed after 100000 sheets | — | — |
| C. E. 12 | C12 | — | — | Damaged image is formed after 110000 sheets | — | — |
| C. E. 13 | C13 | — | — | Damaged image is formed after 100000 sheets | — | — |
| C. E. 14 | C14 | — | — | Damaged image is formed after 90000 sheets | — | — |

TABLE-continued

| | Electrophotographic photosensitive member | Evaluation of characteristics of surface layer: Universal hardness ($N/mm^2$) | Evaluation of characteristics of surface layer: Elastic deformation ratio (%) | Durability evaluation for paper feeding: Formation of damaged image | Durability evaluation for paper feeding: Abrasion loss of surface layer after 50000 sheets of paper feeding (μm) | Durability evaluation for paper feeding: Difference in light potential variation after 20000 sheets of paper feeding (V) |
|---|---|---|---|---|---|---|
| C. E. 15 | C15 | — | — | Damaged image is formed after 70000 sheets | — | — |
| C. E. 16 | C16 | — | — | Damaged image is formed after 60000 sheets | — | — |
| C. E. 17 | C17 | 190 | 53 | Damaged image is formed after 140000 sheets | 0.10 | 30 |
| C. E. 18 | C18 | — | — | Damaged image is formed after 110000 sheets | — | — |
| C. E. 19 | C19 | — | — | Damaged image is formed after 130000 sheets | — | — |
| C. E. 20 | C20 | — | — | Damaged image is formed after 120000 sheets | — | — |
| C. E. 21 | C21 | — | — | Damaged image is formed after 110000 sheets | — | — |
| C. E. 22 | C22 | — | — | Damaged image is formed after 90000 sheets | — | — |
| C. E. 23 | C23 | — | — | Damaged image is formed after 80000 sheets | — | — |
| C. E. 24 | C24 | — | — | Damaged image is not formed after 30000 sheets | — | 40 |
| C. E. 25 | C25 | — | — | Damaged image is not formed after 30000 sheets | — | 40 |

Ex.: Example
C. E.: Comparative Example

In Comparative Examples 24 and 25, the durability test for 200000 sheets of paper feeding was not able to be completed, and the durability test was finished when 30000 sheets of paper feeding were conducted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-270098 filed Nov. 27, 2009 and No. 2010-231610 filed Oct. 14, 2010, which are hereby incorporated by reference herein in their entirety.

What is claimed is:

1. An electrophotographic photosensitive member comprising:

a support;

a charge generating layer containing a charge generating substance, formed on the support;

a charge transporting layer containing a charge transporting substance, formed on the charge generating layer, and a surface layer formed on the charge transporting layer, wherein the surface layer comprises:

a cured resin obtained by polymerizing a compound having at least one polymerizable functional group, and a compound represented by general formula (1) below (1)

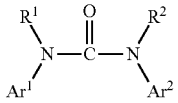

where $R^1$ and $R^2$ are each independently an alkyl group having 1 to 3 carbon atoms and $Ar^1$ and $Ar^2$ are each independently a substituted or unsubstituted aryl group; and a substituent that may be included in the aryl group is a cyano group, an amino group, a hydroxyl group, an alkoxy group, or a halogen atom, and wherein the charge generating substance is a phthalocyanine pigment.

2. The electrophotographic photosensitive member according to claim 1, wherein, in general formula (1), $R^1$ and $R^2$ are the same group and $Ar^1$ and $Ar^2$ are the same group.

3. The electrophotographic photosensitive member according to claim 2, wherein the compound represented by general formula (1) is a compound represented by structural formula (U-1), (U-2), or (U-10) below.

(U-1)

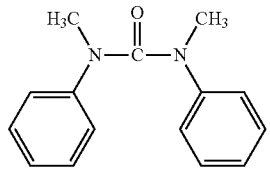

(U-2)

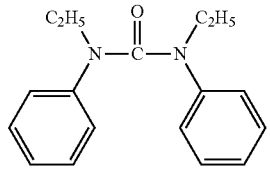

(U-10)

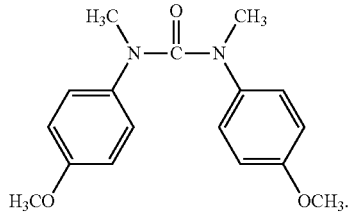

4. The electrophotographic photosensitive member according to claim 1, wherein the surface layer comprises the compound represented by general formula (1) in an amount of 1 to 20% by mass relative to the total mass of the surface layer.

5. The electrophotographic photosensitive member according to claim 1, wherein the compound having at least one polymerizable functional group is a charge transporting compound, and the polymerizable functional group is an acrylic group or a methacrylic group.

6. The electrophotographic photosensitive member according to claim 5, wherein the compound having at least one polymerizable functional group is a charge transporting compound having two or more polymerizable functional groups.

7. The electrophotographic photosensitive member according to claim 6, wherein the compound having at least one polymerizable functional group is a compound represented by general formula (4) below (4)

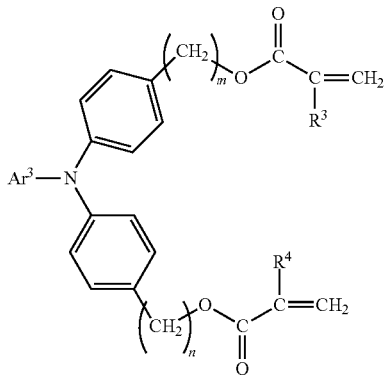

where $R^3$ and $R^4$ are each independently a hydrogen atom or a methyl group, $Ar^a$ is a substituted or unsubstituted aryl group, and m and n are each independently an integer of 0 to 5.

8. The electrophotographic photosensitive member according to claim 7, wherein the compound having at least one polymerizable functional group is a compound represented by structural formula (5) below.

(5)

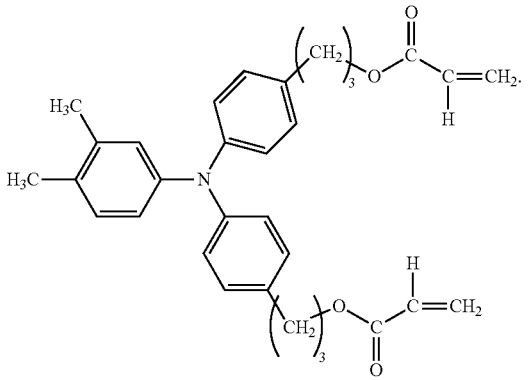

9. A method for producing an electrophotographic photosensitive member which comprises a support, a charge generating layer containing a charge generating substance, formed on the support, a charge transporting layer containing a charge transporting substance, formed on the charge generating layer, and a surface layer formed on the charge transporting layer, the method comprising the steps of:

forming a coated film using a surface layer-forming coating solution that comprises a compound having at least one polymerizable functional group and a compound represented by general formula (1) below; and polymerizing the compound having at least one polymerizable functional group, the compound being contained in the coated film, to form a surface layer (1)

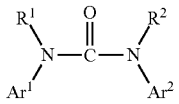

where $R^1$ and $R^2$ are each independently an alkyl group having 1 to 3 carbon atoms and $Ar^1$ and $Ar^2$ are each independently a substituted or unsubstituted aryl group; and a substituent that may be included in the aryl group is a cyano group, an amino group, a hydroxyl group, an alkoxy group, a nitro group, or a halogen atom, and wherein the charge generating substance is a phthalocyanine pigment.

10. The method for producing an electrophotographic photosensitive member according to claim 9, wherein the polymerization is performed by irradiating the coated film with an electron beam.

11. A process cartridge detachably installed in a main body of an electrophotographic apparatus, the process cartridge comprising:

the electrophotographic photosensitive member according to claim 1; and at least one unit selected from a charging unit, a developing unit, a transferring unit, and a cleaning unit, wherein the process cartridge integrally supports the electrophotographic photosensitive member and the at least one unit.

12. An electrophotographic apparatus comprising:

the electrophotographic photosensitive member according to claim 1;

a charging unit;

an exposure unit;

a developing unit; and a transferring unit.

* * * * *